United States Patent [19]

Slade

[11] Patent Number: 4,606,207

[45] Date of Patent: Aug. 19, 1986

[54] FORMING NECKS ON HOLLOW BODIES

[75] Inventor: Mark N. Slade, Faringdon, United Kingdom

[73] Assignee: Metal Box Public Limited Company, Berkshire, England

[21] Appl. No.: 646,375

[22] PCT Filed: Dec. 29, 1983

[86] PCT No.: PCT/GB83/00355

§ 371 Date: Aug. 29, 1984

§ 102(e) Date: Aug. 29, 1984

[87] PCT Pub. No.: WO84/02667

PCT Pub. Date: Jul. 19, 1984

[30] Foreign Application Priority Data

Dec. 30, 1982 [GB] United Kingdom ..... 8236977

[51] Int. Cl.[4] ..... B21D 19/06

[52] U.S. Cl. ..... 72/96; 72/110

[58] Field of Search ..... 72/57, 84, 94, 96, 105, 72/106, 110

[56] References Cited

U.S. PATENT DOCUMENTS 3,754,424 8/1973 Costanzo .
3,765,351 10/1973 Kubacki et al. .
3,812,696 5/1974 Kneusel et al. ..... 72/57
4,058,998 11/1977 Franek et al. ..... 72/84
4,064,726 12/1977 Hinze ..... 72/84
4,512,172 4/1985 Abbott et al. ..... 72/84

FOREIGN PATENT DOCUMENTS 2257210 5/1974 Fed. Rep. of Germany .
7821097 2/1979 France .
7927160 6/1980 France .

*Primary Examiner*—Lowell A. Larson
*Attorney, Agent, or Firm*—Christie, Parker & Hale

[57] ABSTRACT

A thin-walled hollow body open at one end, e.g. a metal can body (76), is given a terminal neck (74) by engaging a primary chuck nose (22) sealingly in the open end and pressurizing the body internally to pre-stress it and hold it against a lift pad (16); the latter is lowered so that the sidewall end portion (80) is progressively rolled by forming rolls (46) to form the neck partly in free space (38) and partly against a secondary chuck nose (30) which maintains the pressure seal when the seal between the sidewall and the primary chuck nose is broken. In a modification, the rolls (46) may be withdrawn early, so as to leave a terminal flange on the can body.

34 Claims, 8 Drawing Figures

FORMING NECKS ON HOLLOW BODIES

CROSS REFERENCE TO RELATED APPLICATIONS

Figure 1:
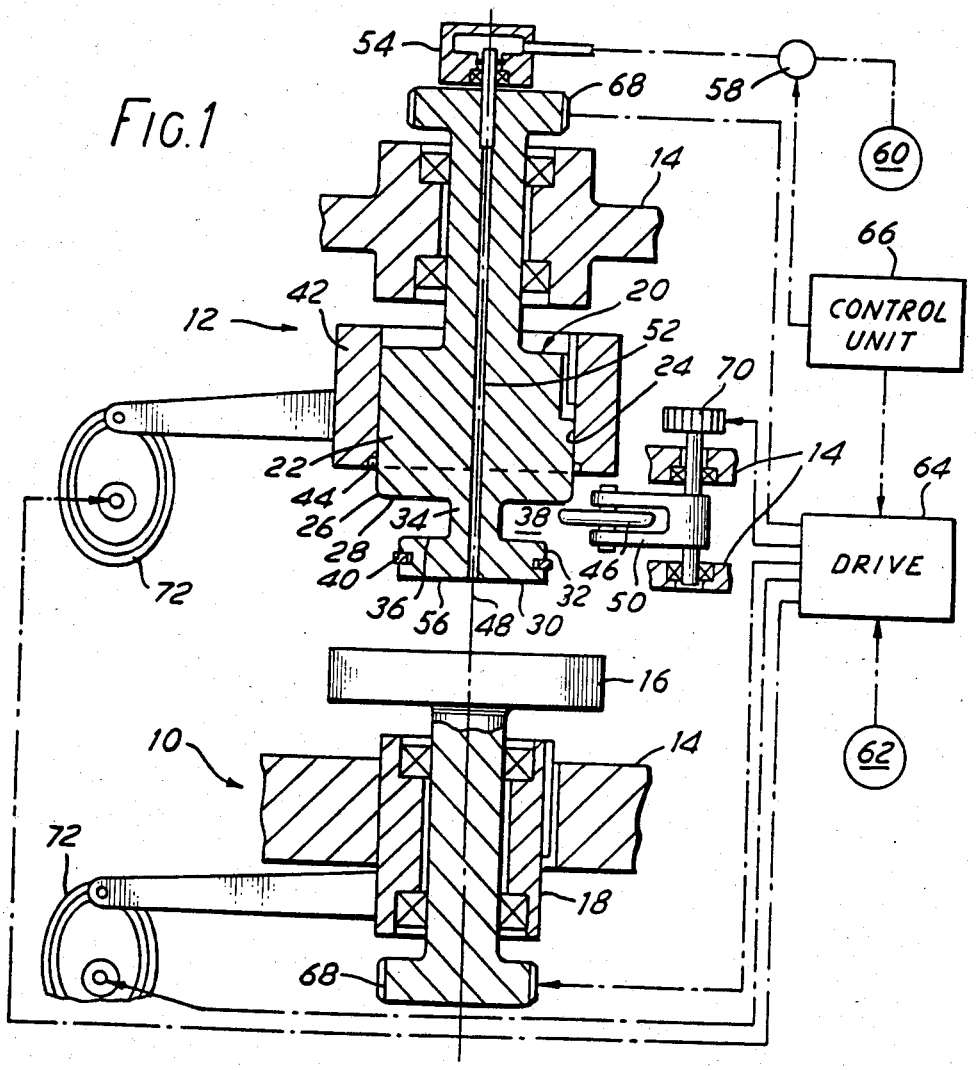

This application is a national application corresponding to international application PCT/GB No. 83/00355, filed Dec. 29, 1983.

This invention relates to methods of, and apparatus for, forming a neck about an open end of a hollow body having its other end closed and comprising a thin cylindrical sidewall, an end portion of which has a terminal edge defining the open end; the invention further relates to such a hollow body when provided with a neck about its open end by a said method.

The hollow body in question is typically a can body made of a metal which will normally be steel (usually though not necessarily, having a coating of metallic tin) or aluminium. Such a can body is particularly likely to be of the unitary kind formed by drawing, with subsequent redrawing or wall ironing or both, and this Description is written with particular reference to unitary can bodies.

It is however to be clearly understood that the invention is applicable to any hollow body as defined above, and not exclusively to can bodies. Furthermore, the hollow body may not be of metal, but may for example be of a plastics material of a kind to which the method may successfully be applied.

The word "thin", as used herein in relation to the sidewall of the hollow body, is not to be taken as implying any particular thickness or range of thicknesses. In respect of the method of the present invention, however, it implies that the sidewall of the hollow body is too thin to be readily worked, so as to form a neck to its final size in a single operation without the danger of uncontrolled wrinkling or other undesired distortion, by methods currently in use for forming terminal necks on metal can bodies. Such methods involve also the forming, either at the same time as the formation of the neck or subsequently, of a terminal flange which is used to form part of the peripheral end seam by which a can end is later secured over the open end of the can body. The methods referred to are die necking, and methods of simultaneously forming the neck and terminal flange by rolling or spinning.

The present Applicants' United Kingdom Patent No. 1534716 describes a typical method and apparatus for forming a terminal neck with radical flange on a can body, whereby the latter is held in axial compression whilst a chuck is engaged axially with its open end. External neck rolling tools are advanced radially into engagement with the sidewall of the can body whilst a control or limit ring is engaged axially with the terminal end of the can body, to apply the necessary axial compressive force. The limit ring is moved axially so as to remain in engagement with the terminal end, whilst the can body is itself moved axially during the neck-forming operation. The can is not supported internally in any way, so that the neck is formed in free space, its shape being determined by appropriately controlling the relative movements of the can body, the limit ring and the external neck rolling tools. This process wil be referred to herein as "spin necking and flanging".

Present methods of forming necks and associated terminal flanges on metal can bodies, where the reduction in diameter, as between the main part of the sidewall and the neck, is greater than a certain amount, involve several stages of working. For example, a single die necking operation will allow only a relatively small reduction in diameter (typically no greater than 4.3% of the material if the can body is tinplate), if localised buckling of the open end or collapse of the main part of the sidewall are to be avoided. Thus if a greater overall reduction in diameter is called for when die necking is used, this must be effected in two or more separate operations. On the other hand, whilst the use of the spin necking and flanging process can reduce the number of separate operations required for a given reduction in diameter, it does not permit the formation of a flange having an external diameter smaller than the original diameter of the adjacent portion of the sidewall. With certain degrees of overall reduction in diameter in necking, this would result in an unacceptably wide flange. In such cases it is accordingly necessary to perform a preliminary pre-necking operation, which in the present state of the art involves one or more stages of die necking, before the whole process is completed by spin necking and flanging.

In addition, for a given can body size and required diameter reduction, the number of separate operations required is generally larger if the can body is of tinplate than if it is of aluminium. In the case of the severest reductions, what is just commercially possible for aluminium can involve, for tinplate, too many operations to be economically worthwhile.

It is thus desirable to decrease the number of separate operations necessary in order to effect necking and flanging of a hollow body.

With current trends in the can making industry towards so-called lightweight containers, i.e. cans with even thinner sidewalls, made from harder materials, both die necking and spin necking and flanging tend to become more difficult to achieve satisfactorily in high-quantity production. In the case of die necking, this means a smaller reduction in diameter in each operation, which in turn would imply more operations, particularly if there is a demand for even narrower necks.

According to the invention, in a first aspect, there is provided a method of forming a neck about an open end of a hollow body having its other end closed and comprising a thin cylindrical sidewall, an end portion of which has a terminal edge defining the open end, the method comprising the steps of: (i) supporting the closed end of the hollow body by support means; (ii) engaging, within the end portion of the sidewall, a primary chuck element having a primary tool edge formed circumferentially of the chuck element; (iii) applying to the closed end of the hollow body a continuous axial force sufficient to hold the closed end against the support means; (iv) controlledly increasing the axial distance between the chuck element and the support means, so as to move the terminal edge past the primary tool edge, whilst applying guide means to prevent radial deformation of the part of the end portion for the time being around the primary chuck element; and (v) applying, during step (iv), external rolling means to the sidewall immediately forward of the primary tool edge, with relative rotation as between the hollow body and the rolling means, about the axis of the former, so that the latter forms the neck by rolling, the said continuous axial force being maintained throughout step (v) as the axial distance between the latter and the primary chuck element is increased.

Preferably, the said continuous axial force is applied by introducing a fluid pressure into the hollow body, the fluid pressure being maintained throughout step (v) such as to be at least sufficient to maintain the hollow body in contact with the support means, and the primary chuck element providing a primary seal with such of the end portion of the sidewall as for the time being surrounds it. The fluid pressure within the hollow body, when used, besides holding the bottom of the latter against the support means, acts to provide internal support to the can sidewall, thus tending to stiffen the latter. This also has the effect of tending to prevent inward buckling or wrinkling of the sidewall material, depending upon the pressure chosen.

In preferred embodiments of the method of the invention, step (i) comprises engaging, within the end portion of the sidewall, the primary chuck element, being part of a chuck member which comprises also a generally cylindrical, secondary chuck element which is disposed coaxially forwardly of the primary chuck element to define a peripheral free working space extending radially inwardly between the chuck elements from their peripheral edges, step (iv) comprising controllably increasing the axial distance between the chuck member and the support means so as to move the terminal edge past the primary tool edge (whilst applying the said guide means) and subsequently past the secondary chuck element, the external rolling means being so applied as to urge sidewall material into contact with the secondary chuck element whereby to form at least that portion of the neck having the least diameter.

Preferably, in embodiments employing internal fluid pressure, when the sidewall material is urged into contact with the secondary chuck element, the latter effects circumferential sealing engagement with the sidewall so as to provide a secondary seal, the increase in axial distance between the chuck member and the support means, and the operation of the external rolling means, being so controlled that the secondary seal is established before the terminal edge reaches a position relative to the primary chuck element such as to cause the primary seal, provided by the latter, to be broken; whereby the fluid pressure is maintained throughout step (iv).

The external rolling means are preferably so controlled that, once sidewall material has initially been urged into contact with the secondary chuck element, the sidewall continues to be rolled against the secondary chuck element as the axial distance between the chuck member and support means is further increased, whereby to produce a substantially cylindrical neck portion.

The method can be used in a pre-necking operation, by producing a substantially cylindrical neck portion as set out above, and by continuing to roll the sidewall against the secondary chuck element until the terminal edge reaches the external rolling means, whereby the neck comprises a substantially cylindrical terminal neck portion.

In the pre-necking version of the method, the external rolling means are not withdrawn until after the terminal edge has passed them. However, different effects may be obtained by interrupting the increase in axial distance between the primary chuck element and support means at a predetermined stage during step (iv), and withdrawing the rolling means before the said increase in axial distance is resumed, whereby no further deformation in the sidewall is effected. This option may be exercised whether or not the secondary chuck element is present, depending on whether its sealing or its depth-limiting function is required.

In one embodiment of the method in which the external rolling means are withdrawn before step (iv) is completed, the relative axial movements are stopped and the rolling means withdrawn after the terminal edge has reached the primary tool edge, but whilst there is an outwardly-directed flange portion terminating in the terminal edge and leading into the portion of the neck having the least diameter. This provides a method of necking and flanging the body in a single operation where the degree of diameter reduction in the neck is small enough to enable the neck itself to be formed in a single operation. Preferably the rolling means ceases to co-operate with the chuck member to draw sidewall material radially inwardly from the flange portion after the terminal edge has passed the primary tool edge, so that the final outside diameter of the terminal flange portion is less than the original diameter of the sidewall.

In another embodiment, the interruption of increase in axial distance, and the withdrawal of the external rolling means, take place before the terminal edge reaches the primary tool edge, whereby to leave a substantially cylindrical sidewall portion terminating in the terminal edge and joined to an annular, generally radially-extending portion of the neck.

If a fluid medium is employed whereby the hollow body is pressurised, this medium is preferably compressed air, introduced through the chuck member. Normally the pressure is chosen so as to be sufficient substantially to prevent the cross-sectional shape of the hollow body from becoming non-uniform as between any two diametral planes through the body. However, it is found to be possible to control the pressure at a reduced value to produce a form of so-called "stylized" can body. In this version of the method, the pressure has a value just sufficiently low to permit a substantially uniform series of dimples to be formed during step (v), by virtue of the various forces then acting on the hollow body, circumferentially around the sidewall in the region of the junction of the neck with the remainder of the sidewall.

It has been mentioned above that in certain cases the necking operation may be interrupted so as to leave a terminal flange, thus allowing the method of the invention to be employed in a single necking and flanging operation. Where it is necessary to form the neck in more than one operation, the method is employed in the pre-necking mode set forth above, so as to form a substantially cylindrical terminal neck, and the latter is subsequently re-formed so as to form a peripheral flange. The forming of the flange is preferably formed in a single operation. One way of doing this is by a conventional spin flanging process. Alternatively, where a further reduction in the diameter of the neck is called for, this may be performed, simultaneously with forming the flange, by the combined necking and flanging process described in the aforementioned United Kingdom patent No. 1534716.

The method is thus particularly suitable for use in connection with metal can bodies requiring more than one operation to form a neck and flange due to the reduction in diameter required. For example, the standard beverage can in the United Kingdom has a sidewall of diameter 65.66 millimeter (2.585 inches or Size 211). This can may be required to have a neck whose smallest internal diameter is, for example, either 59.94 millimeter (2.360 inches or Size 207½) or 57.4 millimeter (2.260 inches or Size 206). Under current practice in the industry, the process of forming such necks, with terminal flanges, on Size 211 can bodies calls for the sequence of operations set out in the following table, in which Column 1 shows one sequence of operations and Column 2 shows an alternative sequence, both using methods currently known. Column 3 shows the operations necessary where a method according to the present invention is employed, and illustrates how the invention enables the number of operations to be reduced. The sidewall thickness of the can body is assumed to be the same in each case, viz. of a conventional value as currently employed for modern beverage cans.

| Small Internal Diameter of Neck | Can Body Material | 1 | 2 | 3 |
|---|---|---|---|---|
| 59.94 mm (Size 207½) | Aluminum | (1) Die neck to intermediate diameter (2) Die neck to final diameter (3) Spin flange | (1) Die neck to intermediate diameter (2) Spin necking and flanging operation to final neck diameter | Neck and flange in one operation according to the invention |
| 59.94 mm (Size 207½) | Tinplate | (1) Die neck to first intermediate diameter (2) Die neck to second intermediate diameter (3) Die neck to final diameter (4) Spin flange | (1) Die neck to first intermediate diameter (2) Die neck to second intermediate diameter (3) Spin necking and flanging operation to final neck diameter | Neck and flange in one operation according to the invention |
| 57.4 mm (Size 206) | Aluminum | Four operations as for 59.94 mm in tinplate, above | Three operations as for 59.94 mm in tinplate, above | (1) Pre-neck to intermediate diameter according to the invention (2) Spin necking and flanging operation to final neck diameter |
| 57.4 mm (Size 206) | Tinplate | Three die necking operations followed by spin flanging | Two die necking operations followed by spin necking and flanging operation to final neck diameter | Two operations as for 57.4 mm in aluminum, above |

It should be noted that the processes given in Columns 1 and 2 in respect of tinplate can bodies to be given necks of 57.4 millimeter are in fact not believed to be in commercial use, and are thought to be uneconomic.

According to the invention, in a second aspect, there is provided apparatus for forming a neck about an open end of a hollow body having its other end closed and comprising a thin cylindrical sidewall, an end portion of which has a terminal edge defining the open end, the apparatus comprising: (1) support means for supporting the closed end of the hollow body; (2) a chuck member, comprising a primary chuck element, having a primary tool edge formed circumferentially thereof, the primary chuck element being adapted to fit within the said end portion of the sidewall; (3) guide means around the primary chuck element for preventing radial deformation of any part of the said end portion engaged around the primary chuck element; (4) external rolling means for rolling a neck on a hollow body when the latter is supported by the support means, the external rolling means being disposed so as to engage the sidewall of the hollow body immediately forward of the primary chuck element; and (5) means for applying to the closed end of a hollow body engaged around the primary chuck element a continuous axial force to hold the closed end against the support means, the support means and chuck member on the one hand, and the rolling means on the other, being arranged for relative rotation about the axis of the chuck member, and the support means and chuck member being arranged for controllable relative axial movement.

Preferably, the means for applying said continuous axial force comprises means for introducing a fluid under pressure into a said hollow body, the primary chuck element being adapted to provide a primary seal within the said end portion of such hollow body when fitting within a said end portion. Preferably the chuck member has fluid passage means for introduction of a said fluid through the chuck member.

In alternative embodiments, the means for applying said continuous axial force comprises mechanical force-applying means having a pusher element for engaging an inner surface of the closed end of a said hollow body and actuating means for moving the pusher element therewith during said controllable relative axial movement whilst applying said axial force through the pusher element.

The guide means preferably comprise an annular guide member disposed coaxially around the primary chuck element.

The annular guide member may be axially movable or fixed. In the former case, it is adapted for light endwise engagement (i.e., applying no significant axial force) upon the terminal edge of a hollow body when the latter is engaged around the primary chuck element, the annular guide member and the primary chuck element being arranged for relative axial movement such that the former can just, but only just remain in contact with the terminal edge when the terminal edge moves along the primary chuck element as far as the first tool edge. If the annular guide member is fixed, on the other hand, it is fixed around the primary chuck member to define an annular gap therebetween in which the end portion of a said hollow body can be slidably accommodated without contact with the terminal edge.

The primary chuck element preferably has a substantially radially-extending forward tool face delimited peripherally by the primary tool edge, the rolling means being disposed so as to engage the sidewall of the hollow body whereby to co-operate with the forward tool face in forming a radial flange portion of the sidewall therebetween.

The chuck member preferably further comprises a secondary, generally-cylindrical, chuck element disposed co-axially forwardly of the primary chuck element to define a peripheral free working space extending radially inwardly between the chuck elements from their peripheral edge, whereby a said neck can be rolled into the free working space and into engagement with the secondary chuck element.

In a third aspect, the invention provides a hollow body having a neck formed in a cylindrical sidewall thereof, about an open end of the body, by a method according to the invention.

Figure 2:
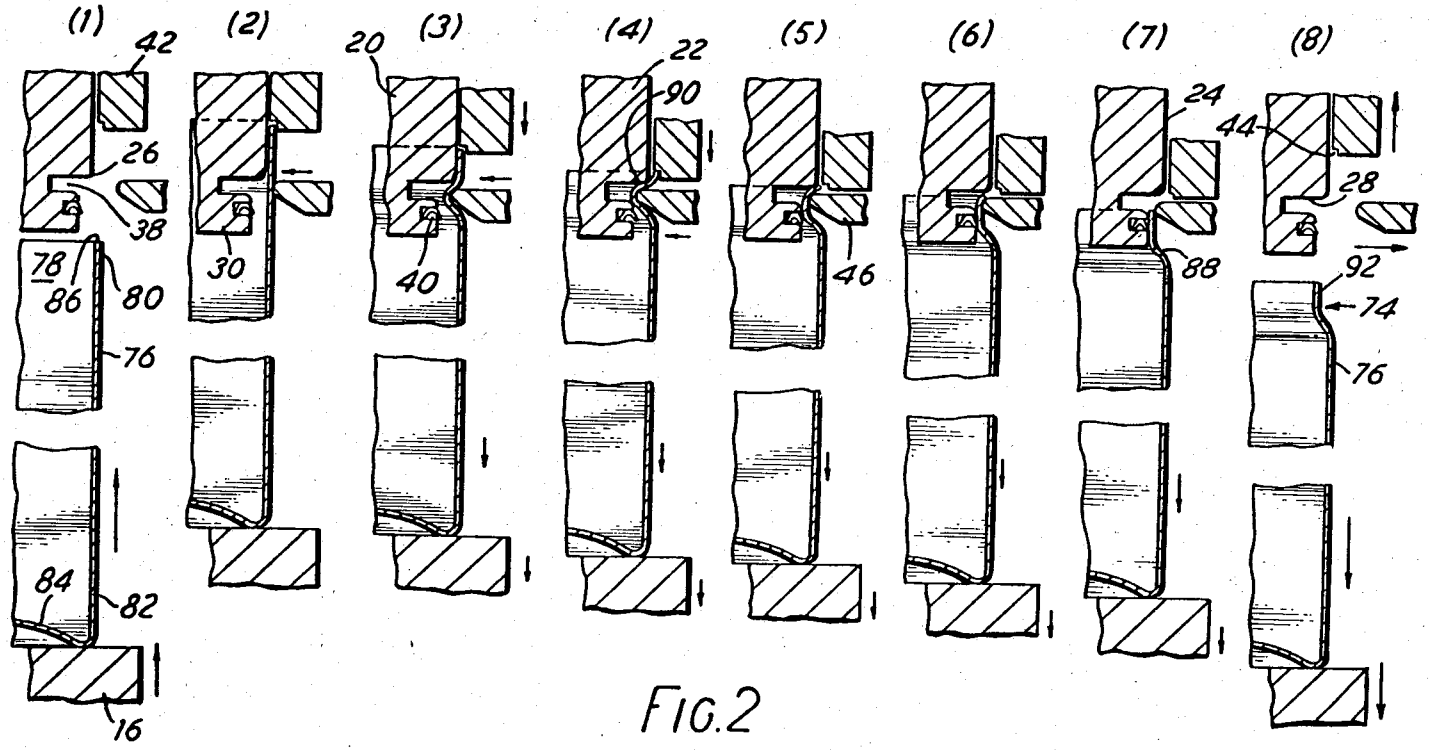
Figure 3:
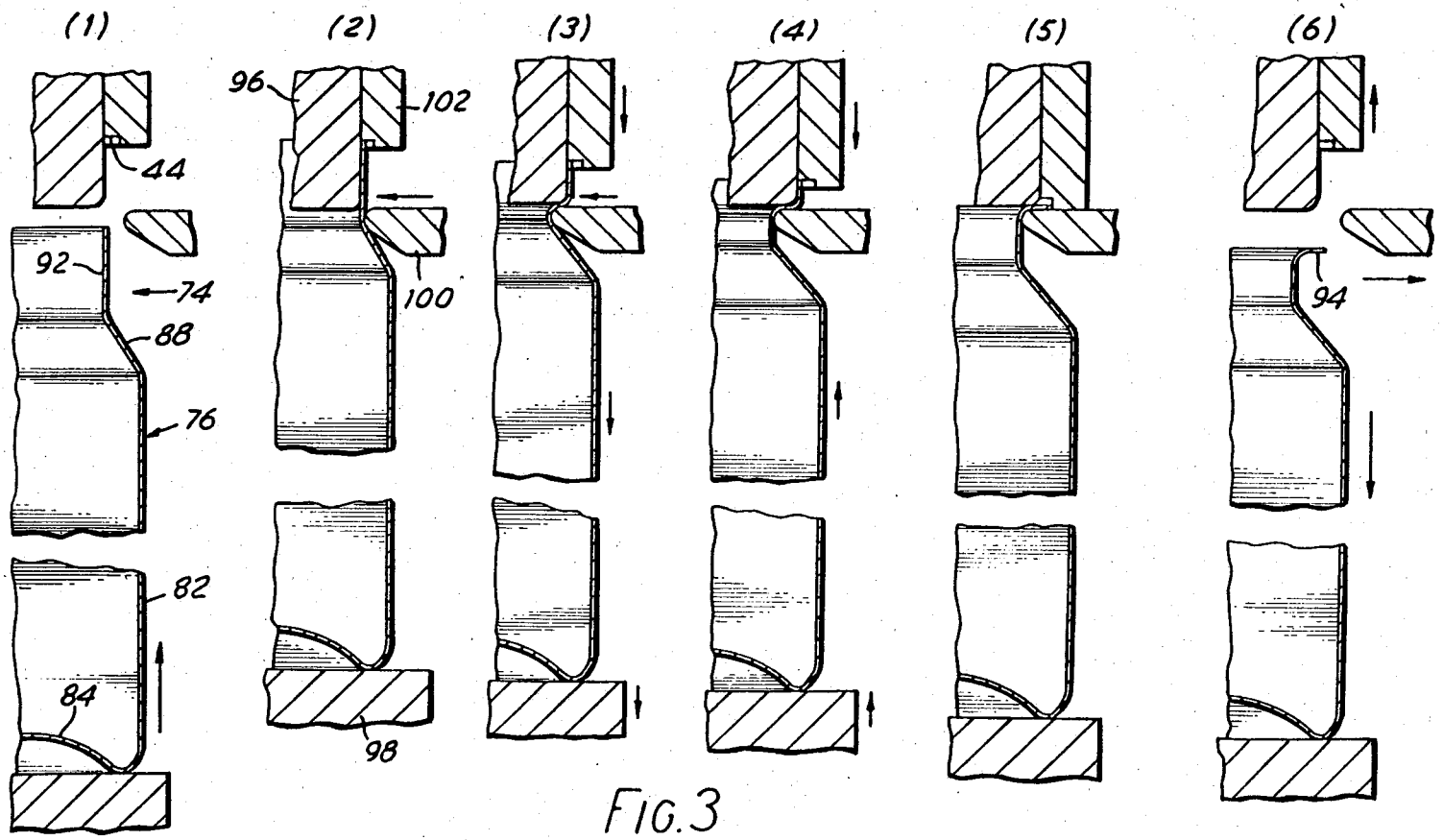
Figure 4:
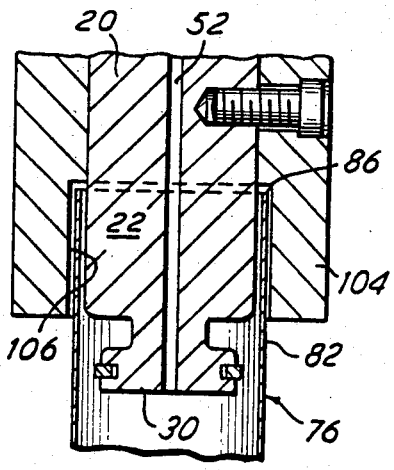
Figure 6:
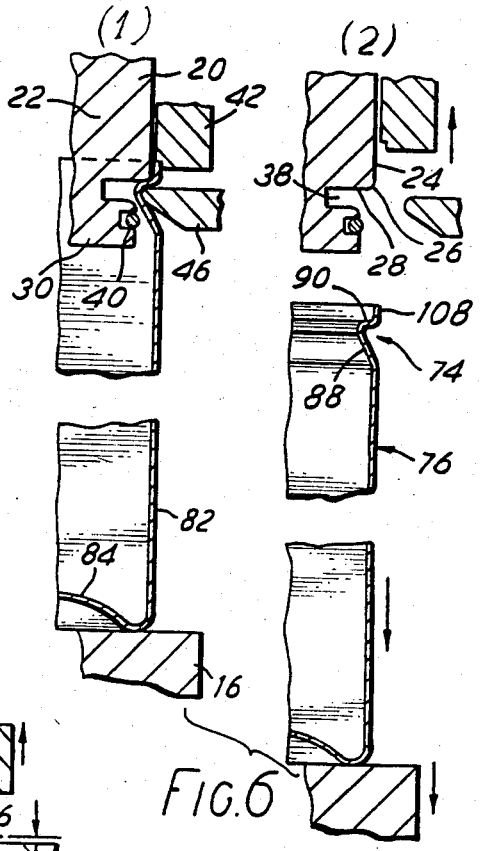
Figure 5:
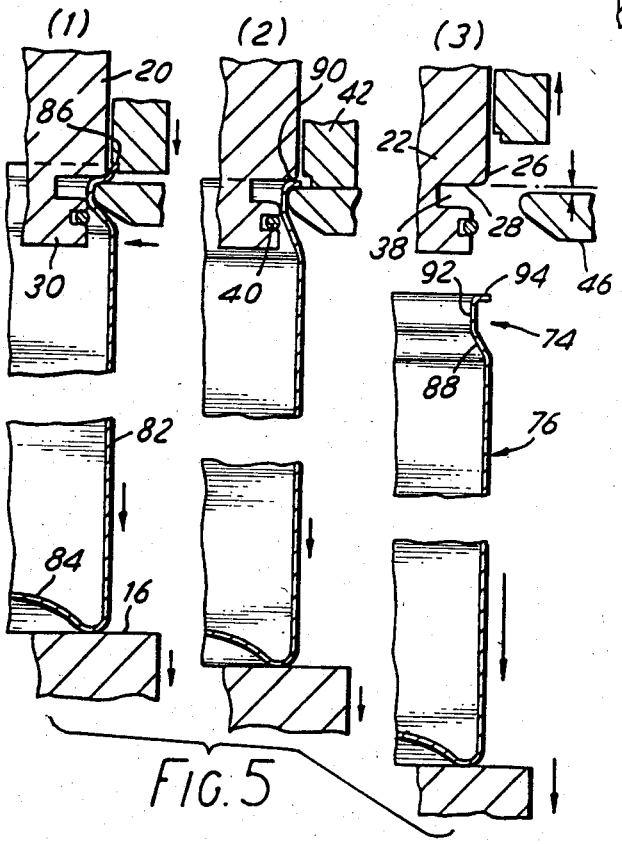
Figure 7:
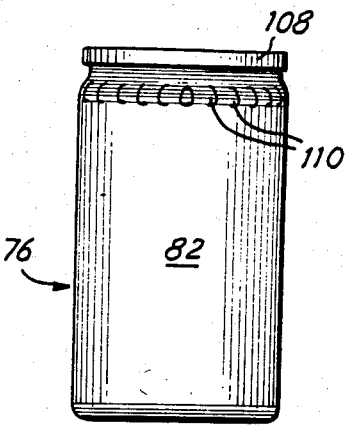
Figure 8:
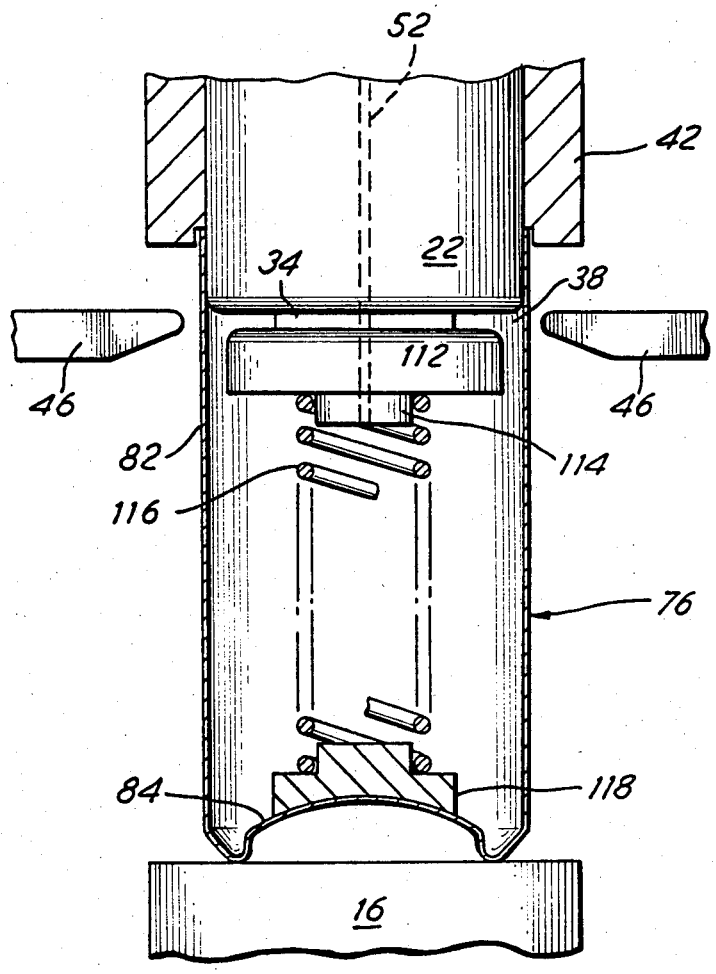

Embodiments of the invention will now be described, by way of example only, with reference to the drawings of this Application, in which:

FIG. 1 is a diagram illustrating, in strictly schematic form, principal component functions of a machine (hereinafter referred to as a "necking machine") for forming a neck on an end portion of the cylindrical sidewall of a metal can body, the diagram including a much-simplified sectional elevation of an embodiment of tooling, for performing a method according to the invention;

FIG. 2 consists of a progressive series of eight sectional part-elevations showing eight stages in the pre-necking of a metal can body by a method according to the invention;

FIG. 3 consists of a progressive series of six sectional part-elevations, showing a further operation whereby a can body, pre-necked as illustrated in FIG. 2, has its neck further reduced in diameter and a terminal flange formed thereon, by a spin necking and flanging operation;

FIG. 4 is a simplified sectional elevation of a chuck member and fixed control ring, being part of the tooling in a modified embodiment of apparatus according to the invention;

FIG. 5 consists of a progressive series of three sectional elevations illustrating an embodiment of the method according to the invention in which a can body is formed with a terminal neck and flange in a single operation;

FIG. 6 consists of a progressive series of two sectional elevations illustrating another embodiment of the method according to the invention;

FIG. 7 shows a stylized can body formed in yet another embodiment of the method of the invention; and FIG. 8 is a simplified sectional elevation showing another embodiment of the tooling.

Referring first to FIG. 1, the necking machine comprises tooling in the form of a lift pad assembly 10 aligned with, and directly below, a necking head assembly 12, both the assemblies 10 and 12 being carried by a main frame of the machine indicated diagrammatically at 14. The necking machine constitutes apparatus for forming a neck about an open end of a hollow body in the form of an aluminium or tinplate can body (not shown in FIG. 1), having its other end closed and comprising a thin cylindrical sidewall, an end portion of which has a terminal edge defining an open end.

The lift pad assembly 10 comprises support means in the form of a lift pad 16, which is shown in FIG. 1 as rotatable in a lift pad carrier 18, the latter being mounted for axial movement in the main frame 14, so as to raise and lower the lift pad 16.

The necking head assembly 12 comprises a chuck member 20 which is shown diagrammatically in FIG. 1 as rotatable in the main frame 14. The chuck member 20 is not movable axially with respect to the main frame. It comprises a primary chuck element (or chuck nose) 22 having a generally-cylindrical outer surface 24 terminating in a primary tool edge 26 at its lower or forward end. The primary tool edge 26 is formed with a predetermined radius, and forms the periphery of a substantially radially-extending, planar forward tool face 28 of the primary chuck nose. The chuck member 20 also includes a secondary chuck element (or chuck nose) 30, which is carried below the primary chuck nose 20, i.e. axially forward of the latter. The secondary chuck nose 30 has a generally cylindrical outer surface 32 and is joined coaxially to the primary chuck nose 20 by means of a central stem 34. The stem 34 is of relatively small girth, so that, between the forward face 28 of the primary chuck nose and the rearward face, 36, of the secondary chuck nose, there is an annular, peripheral free working space 38. The working space may be regarded as extending radially inwardly from the peripheral edges of the two chuck noses, viz. the primary tool edge 26 and the peripheral edge 40 of the rear face of the secondary chuck nose. The outer cylindrical surface 32 of the latter carries a circumferentially-extending and radially-projecting sealing means, which in this example consists of a metal piston ring 40 carried in a circumferential groove formed in the surface 32. The greatest diameter of the secondary chuck nose, i.e. the outer diameter of the sealing means 40 when the latter is in its relaxed or uncompressed condition, is smaller than the greatest diameter of the primary tool edge 26, i.e. the diameter of the cylindrical outer surface 24 of the primary chuck nose.

Around the primary chuck nose 22 there is a guide means, in the form of an annular control ring 42, which has a cylindrical bore slidable along the outer surface of the primary chuck nose 22. The bore of the control ring 42 has at its leading end a peripheral rebate 44, the purpose of which is to engage the terminal edge of the can body in an endwise manner and to prevent radial deformation of any part of the end portion of the can body sidewall engaged around the cylindrical surface 24 of the primary chuck nose, as will be seen more clearly hereinafter.

The tooling, insofar as concerns tool elements for physical engagement with the can body, comprises the chuck member 20, the lift pad 16, and external rolling means in the form of at least one forming roll. One forming roll is indicated in FIG. 1 at 46, though there will usually be two or three, arranged in equi-spaced relationship around the common axis, 48, of the chuck member and lift pad. For the purposes of this description, the forming rolls 46 will be referred to in the plural. They are arranged in conventional manner, that illustrated by way of example in FIG. 1 being shown as rotatably mounted in a forming roll carrier 50, which is itself rotatably carried by the main frame 14 of the machine, so that the forming rolls may be swung in a radial plane towards and away from the central axis 48 whereby to roll a neck on the can body as will be described more fully hereinafter. The forming rolls are mounted so as to lie at the same level as the free working space 38, so that they can enter the latter during the neck-forming operation.

Means are provided for introducing a fluid under pressure into a can body engaged by the chuck member 20, again as will be described more fully below. The fluid in this example is compressed air, though it will be understood that any suitable fluid (preferably a compressed gaseous medium) may be employed. The means for introducing compressed air comprises an axially-extending air duct 52 which extends from a suitable rotary coupling 54, arranged externally on the chuck member 20, and through the latter to exhaust through the leading face of the chuck member, in this example the leading face 56 of the secondary chuck nose. The air duct 52 is connected, through the coupling 54 and a suitable air control valve 58, to a source 60 of compressed air.

Means are provided for: rotating the chuck member 20 and lift pad 16, at the same rotational velocity as each other, about their common axis 48; raising and lowering the lift pad 16; raising and lowering the control ring 42; effecting the movement of the forming rolls 46 towards and away from the axis 48; and operating the air valve 58. It will be understood that these means, and the manner in which they are controlled so as to perform the operations to be described hereinafter, may take any convenient form. The said means and their control are schematically illustrated in FIG. 1 in one particular form simply by way of example, and not with the invention of implying that they must take this particular form.

Accordingly, FIG. 1 indicates a main drive motor 62 of the necking machine, the main drive motor being coupled to suitable mechanical transmission or drive means, 64, which in turn is coupled to the various driven components of the tooling in any suitable manner. The drive means 64 is such as to drive any one tooling component either independently or in a manner related to the movement of any one or more of the other tooling components, according to the requirements of the process. It is essentially adapted to operate in sequential manner and, to this end it is, for example, controlled by a suitable programmable control unit 66. The programmable control unit 66 is also coupled to the air valve 58, so as to operate the latter in its due place in the sequence of operation.

As to the manner by which the various tooling components are driven by the drive means 64, purely by way of illustration FIG. 1 shows the following. Rotation of the chuck member 20 and of the lift pad 16 is shown as effected through gearing of which the final drive wheels are indicated at 68. Similarly, the movement of the forming rolls 46 in a radial plane is shown as effected by gearing of which a final drive wheel is indicated at 70, the wheel 70 being coaxially mounted on the pivot of the roll carrier 50. In practice, movement of the rolls 46 may be effected using a cam drive.

Axial movement of the control ring 42, and axial movement of the lift pad assembly 10, are indicated as being obtained from rotatable cams 72.

Referring now to FIG. 2, a neck 74 is formed on a metal body 76 in the following manner, by way of prechecking prior to the formation of a terminal flange on the can body by a separate operation. The can body has its top end 78 open, the open end 78 being defined by an end portion, generally indicated at 80, of the cylindrical can sidewall 82. The bottom end 84 of the can body is closed.

The can body 76 is delivered, by any conventional means (not shown) on to the lift pad 16, the latter being in its lowest position, so that the axis of the can coincides with the tooling central axis 48 (FIG. 1). The chuck member 20 and lift pad 16 are in continuous rotation about the central axis 48 throughout the operation shown in FIG. 2. As shown in FIG. 2(1), the can body, thus supported on the lift pad, is offered up to the chuck member 20 by raising the lift pad 16. Upward movement of the lift pad is continued until the primary chuck nose 22 is engaged within the end portion 80 of the can body sidewall, as seen in FIG. 2(2).

At this point it should be observed that, in FIG. 2, a radial gap is shown between the end portion 80 and the outer surface 24 of the primary chuck nose, and another radial gap between the control ring 42 and the surface 24. These gaps are shown only for purposes of clarity; in practice the last-mentioned gap may not be present (there being sliding contact between the control ring and the chuck nose), whilst there is no gap between the end portion 80 and surface 24. The primary chuck nose fits sufficiently snugly within the end portion 80 to allow the latter to slide along it whilst yet providing a primary seal against any significant escape of the compressed air which is now introduced into the can body 76 through the air duct 52 (FIG. 1) in the chuck member 20.

The control ring 42 is engaged with the terminal edge 86 of the can body sidewall, so that the edge 86 lies within the rebate 44 of the control ring. It is important here to note that the control ring 42 is so controlled as to exert only a light, i.e. an insignificant axial pressure upon the sidewall 82.

The axial distance between the primary chuck nose 22 and the lift pad 16 is now controllably increased by lowering the latter, and this movement is continued throughout the operation, as can be seen from FIG. 2(3) to FIG. 2(7). The internal air pressure maintains the closed bottom end 84 of the can body in contact with the lift pad 16 as the lift pad is lowered.

The air pressure does however provide another important function, which is that of inducing tensile hoop stresses throughout the can body sidewall, such as to strengthen the latter in the sense of pre-stressing it.

As is seen in FIG. 2(2) and FIG. 2(3), the external forming rolls 46 are advanced towards the working space, and thus towards the sidewall 82 immediately forward of the primary tool edge 26. When the rolls 46 come into engagement with the sidewall, they begin to deform it, by rolling, inwardly in free space, FIG. 2(3), so as to form a lower, convergent portion 88 of the neck 74. FIG. 2(4) shows the stage at which this inward deformation has become just sufficient for the partly-formed neck to have come into engagement with the secondary chuck nose 30. It will be observed from FIGS. 2(3) and 2(4) that the control ring 42 is moved downwardly so as to maintain the terminal edge 86 of the can body within the rebate 44 of the control ring (though still without any, or any significant, axial force being exerted upon the sidewall). In this manner the control ring guides the end portion 80 downwardly along the primary chuck nose and prevents any radially-outward deformation taking place in such part of the end portion 80 as has for the time being not yet reached the radiused primary tool edge 26. The sidewall material is bent around the latter by the forming rolls 46 to form an annular flange portion 90, FIG. 2(4), which leads into the portion of the neck already formed.

Inward movement of the forming rolls is terminated when the neck contacts the secondary chuck nose 30, FIG. 2(4). As the lift pad 16 continues to descend thereafter, a cylindrical portion 92 of the neck therefore commences to be formed, and is forced by the forming rolls into sealing contact with the secondary chuck nose 30, this sealing contact being enhanced or produced by the sealing element 40. In FIG. 2 the sealing element 40 is shown as being a vee-ring of resilient material such as rubber, so arranged in though circumferential groove of the secondary chuck nose that the air pressure within the can body 76 below it tends to open the vee-ring and so further enhance the sealing effect.

As can be seen from FIG. 2(5), the secondary seal provided by the sealing ring 40 is established before the primary seal between the can body end portion 80 and the primary chuck nose surface 24 is broken, which occurs when the terminal edge 86 of the former reaches the primary tool edge 26. In this manner, the internal air pressure is maintained until the terminal edge 86 passes the vee-ring 40 (which occurs just after the stage illustrated in FIG. 2(7)), when the pressure is vented to atmosphere.

Downward movement of the control ring 42 ceases when the terminal edge 86 reaches the tool edge 26. Thereafter, as shown in FIGS. 2(6) and 2(7), the cylindrical neck portion 92 continues to be formed until it constitutes a terminal neck portion, as is best seen in FIG. 2(8), which shows the lift pad being lowered to the position at which the completed pre-necked can body 76 is removed, by suitable means not shown.

Referring now to FIG. 3, the pre-necked can body 76 may be subjected to further reduction in neck diameter, with simultaneous forming of a terminal radial flange 94, by a combined necking and flanging process similar to that described more fully in U.K. Pat. No. 1534716, to which reference is directed for a fuller explanation. This operation is performed using a different chuck member, 96, from that used for the pre-necking operation, the chuck member 96 being of such diameter as to fit snugly within the cylindrical portion 92 of the neck 74. The can body has no internal support, though internal air pressure may if desired be introduced, and a secondary chuck nose employed to provide secondary sealing, in the same manner as has been described above with reference to FIG. 2.

In FIG. 3 there are shown a lift pad 98 and forming roll 100, generally similar to the lift pad 16 and forming roll 46. Around the chuck member 96 there is a limit ring 102, having a rebate 44 which serves the same purpose as the rebate 44 in FIG. 2. However, the spin necking and flanging operation of FIG. 3 differs from the operation described with reference to FIG. 2 in that the limit ring 102 applies axial compression to the can body sidewall 82 throughout the operation until its completion at the stage illustrated in FIG. 3(5). In FIG. 3(1), the can body is shown being offered up to the chuck member 96, whilst in FIG. 3(2) the forming roll is making its initial contact with the sidewall in the cylindrical neck portion 92. The neck is reformed, and the terminal flange 94 formed, in free space by virture of the axial shortening force applied by the limit ring whilst an inward radial force is applied by the forming roll or rolls 100. In FIG. 3(6) the completed can body 76 is shown being lowered by the lift pad for subsequent removal.

If the neck 74 produced in the pre-necking operation described with reference to FIG. 2 does not have to be further reduced in diameter, any known method of forming the terminal flange 94 may be employed thereafter. One example, is the well-known method of spin flanging, whereby a cluster of small internal flanging rolls are engaged with the neck so as to deform an outer end portion of the latter into the form of a flange.

Two specific examples will now be given in which the above-described pre-necking operation is used.

EXAMPLE I

A can body of steel or aluminum, the end portion 80 of whose sidewall has a nominal thickness of 0.089 millimeter (0.0035 inch) and a nominal internal diameter of 65.66 millimeter (2.585 inch, Size 211) is pre-necked, in the manner described with reference to FIG. 2, to a nominal internal diameter, of the cylindrical neck portion 92, of 59.94 millimeter (2.360 inch, Size 207½). The thickness of the neck portion 92 is found to be 0.137 millimeter (0.0056 inch). A terminal flange 94 is subsequently formed by spin flanging.

EXAMPLE II

The same can body as in Example I is pre-necked as in that Example, and its neck is then further reduced whilst a terminal flange is formed as described with reference to FIG. 3, the final nominal internal diameter of the neck being 57.40 millimeter (2.260 inch, Size 206) and its nominal thickness 0.137 millimeter (0.0056 inch).

Referring now to FIG. 4, the control ring may not be movable as is the control ring 42 of FIGS. 1 and 2. Instead, a control ring 104 is, as shown in FIG. 4, fixed around the primary chuck nose 22 so as to define therebetween an annular gap 106, in which the end portion 80 of the can body sidewall can be slidably accommodated. This arrangement ensures that no axial force is communicated at all to the sidewall 82, the control ring nevertheless providing the required radial restraint against deformation of the sidewall above the level of the primary tool edge 26.

Referring to FIGS. 5 and 6, these Figures illustrate two modifications of the method of the invention in which the increase in axial distance between the primary chuck nose 22 and the lift pad 16, i.e. the lowering of the latter, is interrupted at a predetermined stage, and while the lift pad is stationary the forming rolls 46 are withdrawn so as to terminate the neck-forming operation, so that no further deformation of the sidewall of the can body is effected.

In FIG. 5, FIG. 5(1) corresponds to FIG. 2(4), except that in FIG. 5(1) a portion of the cylindrical portion 92 of the neck has, optionally, already been formed. FIG. 5(2) shows the movement of the lift pad stopped when there is still a part of the flange portion 90 lying over the forming rolls 46. In this embodiment it will be observed that the forming rolls are so located axially with respect to the radial forward tool face 28 of the primary chuck nose that sidewall material is drawn substantially radially between, and in contact with, the forming rolls and the tool face 28. The forming rolls are withdrawn at this stage and the resulting can body, with its neck 74 and terminal flange 94, is withdrawn as seen in FIG. 5(3).

FIG. 5 shows another modification of the sealing ring 40 around the secondary chuck nose, namely a resilient O-ring.

The method of FIG. 5 is applicable, for example, to the can body given in Example I above, as an alternative to the two-stage operation of pre-necking followed by spin necking and flanging (i.e. the method of FIG. 2 followed by that of FIG. 3). The radial width of the terminal flange 94 may, in the case given in Example I, at least when performed in accordance with FIG. 5, be 2.18 millimeter (0.086 inch).

Referring to FIG. 6, in this example the neck is formed, as in FIG. 6(1), until there is a residual cylindrical end portion 108 that has not yet reached the primary tool edge 26. Again, the forming rolls 46 are so disposed that the flange portion 90 is generally radial. The forming rolls are withdrawn at the stage shown in FIG. 6(1), the movement of the lift pad having been interrupted for this purpose. The resulting can body is as seen in FIG. 6(2), and is suitable for closing by means of a diaphragm overlying the flange portion 90, the cylindrical end portion 108 being upset over the edge of the diaphragm.

In all of the above examples, the air pressure introduced into the can body is chosen so as to be sufficient substantially to prevent the cross-sectional shape of the body from distorting, as by wrinkling or dimpling, as between any two diametrial planes of the body. However, it may be controlled, if desired, so as to achieve this except that a series of dimples 110, FIG. 7, may be produced circumferentially around the sidewall in the region of the junction of the neck with the remainder of the sidewall.

Referring now to FIG. 8, this illustrates how a continuous axial force, sufficient to hold the closed end 84 of the can body 76 against the lift pad 16 may be applied without the use of internal fluid pressure. The tooling shown in FIG. 8 is generally the same as that shown in FIGS. 1 and 2, except that mechanical force-applying means are provided having a pusher element or nose 118 for engaging the inner surface of the can bottom 84; the force-applying means also comprises actuating means for moving the pusher nose 118 with the can bottom 84 whilst maintaining the application of the axial downward force to the can bottom through the nose 118. The actuating means may comprise a cam-actuated mechanism (not shown) suitably coupled with the drive means 64 and control unit 66 (FIG. 1); alternatively a suitable hydraulic or pneumatic ram or the like may be used, and this may be controlled by the control unit 66 or may be of an uncontrolled form, viz. having a permanently pressurised fluid contained therein and serving as a fluid spring. In either of these embodiments, the actuating means may be carried by the primary chuck nose 22 or may be separate from the latter, e.g. extending through an axial hole in the nose 22.

In the embodiment shown in FIG. 8, the actuating means comprises a compression spring 116 engaged over a spigot 114, formed on the secondary chuck nose 112, and a similar spigot of the pusher nose 118.

In FIG. 8, the air duct 52 is shown so as to illustrate the fact that, even with a mechanical load-applying device, internal air pressure may optionally be used.

I claim:

1. A method of forming a neck about an open end of a hollow body having its other end closed and comprising a thin cylindrical sidewall, an end portion of which has a terminal edge defining the open end, the method comprising:

(i) supporting the closed end of the hollow body by support means;

(ii) engaging, within the end portion of the sidewall, a primary chuck element having a primary tood edge formed circumferentially of the chuck element;

(iii) applying to the closed end of the hollow body a continuous axial force sufficient to hold the closed end against the support means;

(iv) controlledly increasing the axial distance between the chuck element and the support means, so as to move the terminal edge past the primary tool edge, whilst applying guide means to prevent radial deformation of the part of the end portion for the time being around the primary chuck element; and (v) applying, during step (iv), external rolling means to the sidewall immediately forward of the primary tool edge, with relative rotation as between the hollow body and the rolling means, about the axis of the body, so that the rolling means forms the neck by rolling, the said axial force on the closed end being maintained throughout step (v) as the axial distance between the latter and the primary chuck element is increased the steps (i) through (v) being performed absent the application of significant axial force being applied to the sidewall.

2. A method according to claim 1, wherein the said continuous axial force is applied by introducing a fluid pressure into the hollow body, the fluid pressure being maintained throughtout step (v) such as to be at least sufficient to maintain the hollow body in contact with the support means, and the primary chuck element providing a primary seal with such of the end portion of the sidewall as for the time being surrounds it.

3. A method according to claim 2 wherein the pressure of the fluid is chosen so as to be sufficient substantially to prevent the cross-sectional shape of the hollow body from becoming non-uniform as between any two diametral planes through the body.

4. A method according to claim 2 wherein the pressure of the fluid is so controlled as to be sufficient substantially to prevent the cross-sectional shape of the hollow body from becoming non-uniform as between any two diametral planes through the body, save that the save pressure has a value just sufficiently low to permit a substantially uniform series of dimples to be formed during step (v), by virtue of the various forces then acting on the hollow body, circumferentially around the sidewall of the region of the junction of the neck with the remainder of the sidewall.

5. A method according to claim 1, wherein the said continuous axial force is applied by engaging, in step (ii) mechanical force-applying means to the inner surface of the closed end of the hollow body.

6. A method according to claim 1 wherein step (i) comprises engaging, within the end portion of the sidewall, the primary chuck element, being part of a chuck member which comprises also a generally cylindrical secondary chuck element, which is disposed coaxially forwardly of the primary chuck element to define a peripheral free working space extending radially inwardly between the chuck elements from their peripheral edges, step (iv) comprising controllably increasing the axial distance between the chuck member and the support means so as to move the terminal edge past the primary tool edge whilst applying the said guide means and subsequently past the secondary chuck element, the rolling means being so applied as to urge sidewall material into contact with the secondary chuck element whereby to form at least that portion of the neck having the least diameter.

7. A method according to claim 6 in which the said continuous axial force is applied by introducing a fluid pressure into the hollow body, the fluid pressure being maintained throughout step (v) such as to be at least sufficient to maintain the hollow body in contact with the support means, and the primary chuck element providing a primary seal with such of the end portion of the sidewall as for the time being surrounds it, and wherein, when the sidewall material is urged into contact with the secondary chuck element, the latter forms with the sidewall a secondary seal, the increase in axial distance between the chuck member and the support means, and the operation of the external rolling means, being so controlled that the secondary seal is established before the terminal edge reaches a position relative to the primary chuck element such as to cause the primary seal to be broken whereby the fluid pressure is maintained throughout step (v).

8. A method according to claim 6 wherein the external rolling means are so controlled that, once sidewall material has initially been urged into contact with the secondary chuck element, the sidewall continues to be rolled against the secondary chuck element as the axial distance between the chuck member and support means is further increased, whereby to produce a substantially cylindrical neck portion.

9. A method according to claim 8, wherein the sidewall continues to be rolled against the secondary chuck element until the terminal edge reaches the rolling means, whereby the neck comprises a substantially cylindrical terminal neck portion.

10. A method according to claim 9 for forming a neck, terminating in a peripheral flange, about an open end of a hollow body having its other end closed and comprising a thin cylindrical sidewall, an end portion of which has a terminal edge defining the open end, the method comprising the steps of: (a) forming a neck, having a substantially cylindrical terminal neck portion and (b) subsequently reforming the said terminal neck portion so as to form the peripheral flange.

11. A method according to claim 10 wherein stage (b) is performed in a single operation which comprises reducing further the diameter of the said terminal neck portion and forming the terminal flange, by supporting the hollow body in axial compression while deforming the terminal neck portion in free space by applying an axial shortening force thereto simultaneously with an inward radial force.

12. A method according to claim 1 wherein the increase in axial distance between the primary chuck element and support means in interrupted at a predetermined stage during step (iv), and the external rolling means are withdrawn before the said increase in axial distance is resumed, whereby no further deformation in the sidewall is effected.

13. A method according to claim 12, wherein the interruption of increase in axial distance, and the withdrawl of the rolling means, takes place before the terminal edge reaches the primary tool edge, whereby to leave a substantially cylindrical sidewall portion terminating in the terminal edge and joined to an annular, generally radially-extending portion of the neck.

14. A method according to claim 12, wherein the interruption of increase in axial distance, and the withdrawal of the rolling means, take place after the terminal edge has reached the primary tool edge, but whilst there is an outwardly-directed flange portion terminating in the terminal edge and leading into the portion of the neck having the least diameter.

15. A method according to claim 14, using a said primary chuck element having a substantially radially-extending forward tool face having a periphery defined by said primary tool edge, relative movement in step (v) between the rolling means and the hollow body is effected in a radial plane the axial location of which, with respect to the said tool face, is such that said relative movement causes sidewall material to be drawn substantially radially between, and in contact with both of, the rolling means the tool face, whereby the terminal flange portion is itself substantially radial on completion of step (v).

16. A method according to claim 14 wherein step (v) is terminated by causing the rolling means to cease to cooperate with the chuck member, whereby sidewall material ceases to be drawn radially inwardly from the flange portion, after the terminal edge has passed the primary tool edge, whereby the final outside diameter of the terminal flange portion is less than the original diameter of the sidewall.

17. A method according to claim 6 using a said chuck member having a said secondary chuck element, the greatest diameter of which is smaller than the diameter of the primary tool edge of said primary chuck element.

18. A method according to claim 6, wherein the controlled increase in axial distance between the chuck member and the support means is maintained while the rolling means is forming a portion of the neck in the free working space, such that said portion of the neck is convergent towards the open end of the hollow body and which terminates in the said portion of least diameter, said portion of least diameter being formed against the secondary chuck element.

19. A method according to claim 1, using a said guide means comprising an annular guide member, in generally endwise engagement with the terminal edge of the hollow body, and wherein step (ii) further comprises effecting relative axial movement as between the primary chuck element and the annular guide member, whereby to maintain contact of the guide member around the terminal edge.

20. A method according to claim 1, using a said guide means comprising an annular guide member fixed around the primary chuck element to define an annular gap therebetween, and wherein step (ii) further comprises initially accommodating the end portion of the sidewall within said annular gap, whereby restraint against radial deformation of the end portion is provided during the step (iv) by the annular guide member.

21. Apparatus for forming a neck about an openend of a hollow body having its other end closed and comprising a thin cylindrical sidewall, an end portion of which has a terminal edge defining the open end, the apparatus comprising:

(1) support means for supporting the closed end of the hollow body;

(2) a chuck member, comprising a primary chuck element, having a primary tool edge formed circumferentially thereof, the primary chuck element being adapted to fit within the said end portion of the sidewall;

(3) guide means around the primary chuck element to provide restraint against radial deformation of any part of the said end portion engaged around the primary chuck element;

(4) external rolling means for rolling a neck on a hollow body when the latter is supported by the support means, the external rolling means being disposed so as to engage the sidewall of the hollow body immediately forward of the primary chuck element; and (5) force-applying means for applying a continuous axial force at the closed end of a hollow body to hold the closed end against the support means, without applying said axial force to the body sidewall, the support means and chuck member on the one hand, and the rolling means on the other, being arranged for relative rotation about the axis of the chuck member, and the support means and chuck member being arranged for controllable relative axial movement.

22. Apparatus according to claim 21, wherein the force-applying means comprises means for introducing a fluid under pressure into a said hollow body, the primary chuck element being adapted to provide a primary seal within the said end portion of such hollow body when fitting within a said end portion.

23. Apparatus according to claim 22, characterised in that the means for applying said continuous axial force comprises mechanical force-applying means having a pusher element for engaging an inner surface of the closed end of a said hollow body and actuating means for moving the pusher element therewith during said controllable relative axial movement whilst applying said axial force through the pusher element.

24. Apparatus according to claim 21 wherein the guide means comprise an annular guide member disposed coaxially around the primary chuck element.

25. Apparatus according to claim 24, wherein the annular guide member is adapted for light endwise engagement with the terminal edge of a hollow body when the latter is engaged around the primary chuck element, the guide member and the primary chuck element being arranged for relative axial movement such that the former can remain in contact with the terminal edge without imposing significant axial forces to the sidewall when the terminal edge moves along the primary chuck element as far as the first tool edge.

26. Apparatus according to claim 24, wherein the annular guide member is fixed around the primary chuck member to define an annular gap therebetween in which the end portion of a said hollow body can be slidably accommodated without contact with the terminal end.

27. Apparatus according to claims 21 wherein the chuck member further comprises a generally-cylindrical, secondary chuck element disposed co-axially forwardly of the primary chuck element to define a peripheral free working space extending radially inwardly between the chuck elements from their peripheral edges, whereby a said neck can be rolled into the free working space and into engagement with the secondary chuck element.

28. Apparatus according to claim 27 wherein the means for applying said continuous axial force comprises means for introducing a fluid under pressure into a said hollow body, the primary chuck element being adapted to provide a primary seal within the said end portion of such hollow body when fitting within a said end portion, and the secondary chuck element being adapted to effect circumferential sealing engagement within the sidewall of a said hollow body when the sidewall as been deformed against it by the rolling means.

29. Apparatus according to claim 27, wherein the secondary chuck element has a diameter of smaller than the diameter of the primary tool edge.

30. Apparatus according to claim 31, wherein said force-applying means comprises a pusher element, for directly engaging an inner surface of the closed end of a said hollow body, and actuating means coupled with said pusher element for moving the latter therewith during said controllable relative axial movement while simultaneously applying said axial force through the pusher element.

31. Apparatus according to claim 21, wherein the primary chuck element has a substantially radially-extending forward tool face the periphery of which is defined by the primary tool edge, the rolling means being disposed in a plane adjacent the primary tool edge such that the rolling means will engage the hollow body sidewall in such a manner as to cooperate with the forward tool face in forming a radial flange portion of the sidewall therebetween.

32. A method of forming a neck about an open end of a hollow body having its other end closed and comprising a thin cylindrical sidewall, an end portion of which has a terminal edge defining the open end, the method comprising:

(i) supporting the closed end of the hollow body by support means;

(ii) engaging, within the end portion of the sidewall, a primary chuck element having a primary tool edge formed circumferentially of the chuck element, the primary chuck element being part of a chuck member which also includes a cylindrical secondary chuck element disposed coaxially forwardly of the primary chuck element to define a peripheral free working space extending radially inwardly betwen the primary and secondary chuck elements;

(iii) applying to the closed end of the hollow body a continuous axial force sufficient to hold the closed end against the support means;

(iv) controlledly increasing the axial distance between the chuck member and the support means so as to move the terminal edge past the primary tool edge, while applying guide means to prevent radial deformation of the part of the end portion at the primary tool edge, and subsequently past the secondary chuck element; and (v) applying, during step (iv), external rolling means to the sidewall immediately forward of the primary tool edge with relative rotation as between the hollow body and the rolling means about the axis of the body so that the rolling forms the neck by rolling, the said axial force being maintained throughout step (v) as the axial distance between the support means and the chuck member is increased, the folling means being so applied as to urge sidewall material into contact with the secondary chuck element to form at least the portion of the neck having the least diameter.

33. A method according to claim 32 in which the said continuous axial force is applied by introducing a fluid pressure into the hollow body, the fluid pressure being maintained through step (v) such as to be at least sufficient to maintain the hollow body in contact with the support means, the primary chuck element providing a primary seal with the end portion of the sidewall as surrounds it and wherein when the sidewall material is urged into contact with the secondary chuck element the latter forms with the sidewall a secondary seal, the increase in axial distance between the chuck member and the support means and the operation of the rolling means being so controlled that the secondary seal is established before the terminal edge reaches a position relative to the primary chuck element such as to cause the primary seal to be broken whereby the fluid pressure is maintained throughout step (v).

34. A method for forming a neck about a hollow body having an open end defining an end portion with a terminal edge, a closed end and a thin sidewall, the method comprising:

suppporting the closed end by support means inserting a primary chuck element into the open end, the primary chuck element having a tool edge formed circumferentially about said chuck element; the primary chuck element forming a seal at the open end;

introducing fluid pressure into the hollow body to maintain the closed end against the support means without imposing significant axial forces in the sidewall, the fluid pressure including hoop stresses in said sidewall;

increasing the axial distance between the support means and primary chuck element to move the end portion past the tool edge;

guiding the end portion past the primary chuck element to prevent radial deformation thereof; and applying rolling means to the sidewall immediately forward of the tool edge and inducing relative rotation between the rolling means and the body while increasing said axial distance so that the rolling means, in cooperation with the tool edge, forms a neck at said end portion.

* * * * *